US006585532B2

(12) United States Patent
Uratani et al.

(10) Patent No.: US 6,585,532 B2
(45) Date of Patent: Jul. 1, 2003

(54) COAXIAL CONNECTOR AND COMMUNICATION DEVICE HAVING THE SAME

(75) Inventors: Chikara Uratani, Kanazawa (JP); Kazuo Shima, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/910,976

(22) Filed: Jul. 23, 2001

(65) Prior Publication Data

US 2002/0016101 A1 Feb. 7, 2002

(30) Foreign Application Priority Data

Jul. 21, 2000 (JP) ..... 2000-221400

(51) Int. Cl.[7] ..... H01R 29/00
(52) U.S. Cl. ..... 439/188; 439/513; 200/51.1
(58) Field of Search ..... 439/188, 513; 200/51.1

(56) References Cited

U.S. PATENT DOCUMENTS 3,893,194 A 7/1975 Hayden et al.
4,141,617 A * 2/1979 Freeman ..... 439/391
5,108,300 A * 4/1992 Weber ..... 439/188
6,099,334 A * 8/2000 Togashi ..... 439/188

FOREIGN PATENT DOCUMENTS

| | | | |
|---|---|---|---|
| EP | 0 929 128 | A1 | 7/1999 |
| EP | 0 993 080 | A2 | 4/2000 |
| JP | 62-188066 | | 11/1987 |
| JP | 11-307188 | A | 11/1999 |
| JP | 2001-176612 | A | 6/2001 |
| JP | 2001-196136 | A | 7/2001 |
| WO | WO 00/33425 | | 6/2000 |

* cited by examiner

*Primary Examiner*—Renee Luebke
*Assistant Examiner*—Briggitte R Hammond
(74) *Attorney, Agent, or Firm*—Keating & Bennett, LLP

(57) ABSTRACT

A coaxial connector includes an upper insulating case provided with columnar ribs in the four corners thereof. These ribs are provided to position a fixed terminal and a movable terminal. The tops of the ribs are arranged so that the fixed terminal is easily guided. Half-circular concavities are formed on both of the sides of the fixed terminal. The concavities are fitted onto the ribs of the upper insulating case, so that the fixed terminal can be incorporated into the upper insulating case with a high positional accuracy. Thereafter, the ribs are thermally deformed into a dome shape by a welder, so that the fixed terminal is fixed to the upper insulating case.

18 Claims, 10 Drawing Sheets

COAXIAL CONNECTOR AND COMMUNICATION DEVICE HAVING THE SAME

BACKGROUND OF THE INVENTION

1. Field of the Invention

The present invention relates to a coaxial connector and a communication device including a coaxial connector.

2. Description of the Related Art

In conventional mobile communication devices such as portable telephones, a surface mount type coaxial connector performs a switching function for changing a signal path. In the known configuration of such coaxial connectors, resin members and signal terminals are separately manufactured, and thereafter, the signal terminals are incorporated into the resin members, respectively. For incorporation of the signal terminals into the resin members, in some cases, the configuration in which the signal terminals are sandwiched between two resin members is adopted. In the other cases, the configuration in which the signal terminals are inserted into the resin members under pressure is used.

In the case in which the signal terminals are sandwiched between the two resin members, the signal terminals are sometimes separated and released from the resin members, due to vibration and impact caused when the device elements are conveyed during assembling.

Moreover, in the case in which the signal terminals are inserted between the resin members under pressure, the signal terminals will be inserted under pressure, which causes scraping of the resin members, if the positional relationship between the signal terminals and the resin members set in an assembling apparatus is deviated. Resin dusts and burs are produced, which deteriorates the qualities of the resulting products. Accordingly, to prevent this, the number of control items in the assembly process is increased, and much time is spent to adjust the positions of manufacturing facilities.

SUMMARY OF THE INVENTION

In order to overcome the problems described above, preferred embodiments of present invention provide a coaxial connector in which signal terminals can be accurately positioned and fixed with respect to resin members, and a communication device having such a coaxial connector.

According to a preferred embodiment of the present invention, a coaxial connector includes a first resin member having a concave portion into which a center contact of a mating coaxial connector is inserted, a second resin member for defining an insulating case with the first resin member, a fixed terminal and a movable terminal mounted inside of the insulating case, and an external terminal mounted on the outside of the insulating case and electrically connected to an outer conductor of the mating coaxial connector, wherein one of the first resin member and the second resin member is provided with ribs that are arranged to position the fixed terminal and the movable terminal, respectively.

In the above-described unique configuration, the ribs arranged to position the fixed terminal and the movable terminal, respectively, are disposed on one of the first and second resin members, so that the fixed terminal and the movable terminal are accurately positioned via the ribs.

Preferably, the ribs are thermally deformed so that the fixed terminal and the movable terminal are fixed to one of the first resin member and the second resin member. More preferably, the ribs thermally deformed with a dome shape are provided on one of the first resin member and the second resin member, and rib receiving portions having a reversed dome shape are provided on the other resin member.

In the above-described configuration, the ribs being thermally deformed fix the fixed terminal and the movable terminal, which are signal terminals, to one of the first and second resin members. Accordingly, there is no possibility that the signal terminals are erroneously released from the resin members, which may be caused in conventional devices by vibration and impact while the device elements are conveyed during assembling.

The communication device according to another preferred embodiment of the present invention includes the coaxial connector having the above-described configuration. Thus, a high reliability can be obtained in the communication device.

Other features, elements, characteristics, and advantages of the present invention will become more apparent from the following detailed description of the preferred embodiments of the present invention with reference to the attached drawings.

DETAILED DESCRIPTION OF PREFERRED EMBODIMENTS

Hereinafter, preferred embodiments of the coaxial connector and the communication device of the present invention will be described with reference to the accompanying drawings.

Figure 1:
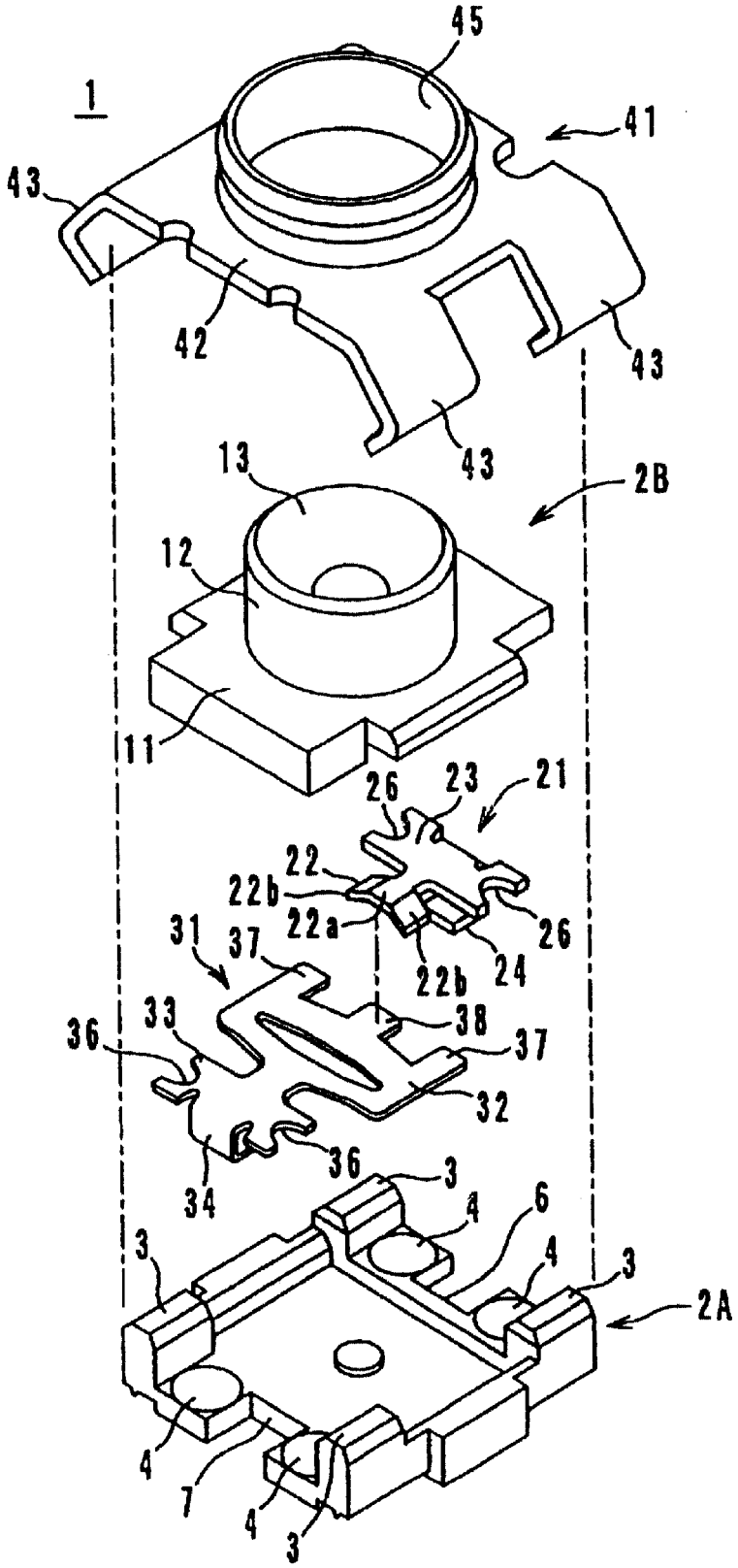
FIG. 1 is an exploded perspective view of a coaxial connector according to a preferred embodiment of the present invention.

FIG. 1 is an exploded perspective view showing the constitution of a preferred embodiment of the coaxial connector of the present invention. The coaxial connector (coaxial receptacle) 1 preferably includes an insulating case made of synthetic resin which includes a lower insulating case 2A and an upper insulating case 2B, a fixed metallic terminal 21, a movable terminal 31, and an external terminal (outer conductor) 41, which are preferably made of metal.

The lower insulating case 2A preferably has a substantially rectangular shape. Guiding protuberances 3 for positioning the upper insulating case 2B are provided preferably at the four corners on the upper surface (dividing plane) of the case 2A. Rib receiving portions 4 for receiving the ribs 18 (see FIG. 2) of the upper insulating case 2B are provided in the vicinity of the respective guiding protuberances 3. The rib receiving portions 4 each has a concave plane shape, i.e., have a reverse dome shape (see FIG. 10). Moreover, substantially rectangular cuts 6 and 7 are formed in the centers of the two opposed sides of the lower insulating case 2A, respectively. In the cut 6, the lead 24 of the fixed terminal 21 is disposed. On the other hand, the lead 34 of the movable terminal 31 is disposed in the cut 7.

The upper insulating case 2B preferably includes a substantially rectangular cover 11 and a columnar introduction portion 12 disposed in the center of the upper surface of the cover 11. The columnar introduction portion 12 is opened in the upper portion thereof so as to have a cone-shape, and has an introduction hole 13 having a substantially circular cross-section. The introduction hole 13 elongates through the upper insulating case 2B. The center contact of a mating coaxial connector protrudes into the introduction hole 13 from the cone-shaped opening side.

Figure 2:
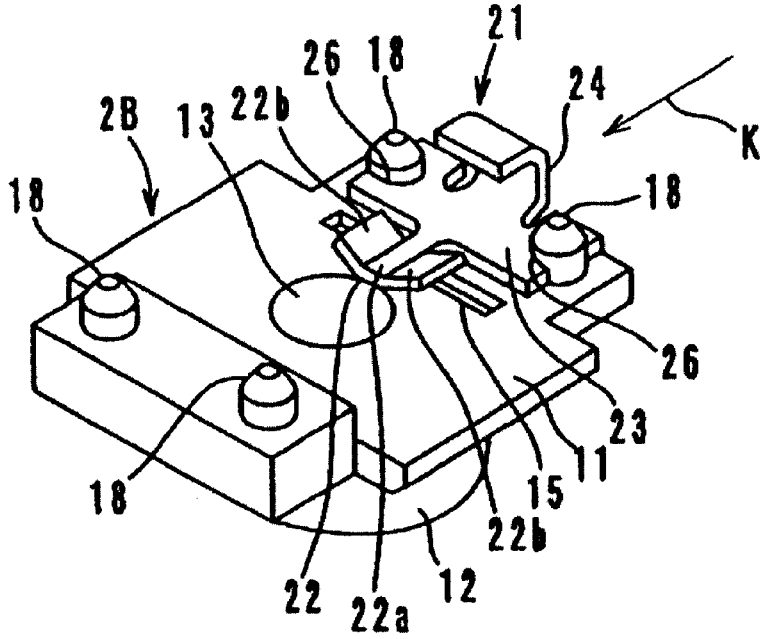
FIG. 2 is a perspective view illustrating an assembly process of the coaxial connector shown in FIG. 1.

Moreover, the columnar ribs 18 are preferably provided in the four corners on the bottom (dividing plane) of the upper insulating case 2B as shown in FIG. 2. These ribs 18 are arranged to position the fixed metallic terminal 21 and the movable terminal 31. The tops of the ribs 18 are worked so as to have a C-shaped plane, so that the terminals 21 and 31 can be easily guided. A groove 15 having a substantially V-shaped cross section is formed between the introduction hole 13 and the side of the upper insulating case 2B from which the fixed terminal 21 is led out. The groove 15 is elongated in a direction that is substantially perpendicular to the leading-out directions of the metallic fixed terminal 21.

The metallic fixed terminal 21 is preferably formed by punching a metallic flat sheet and bending it. The metallic fixed terminal 21 preferably includes a contact portion 22 that contacts with the movable terminal 31, a fixed portion 23 fixedly sandwiched between the insulating cases 2A and 2B, and the lead 24 that is bent to have a substantially L-shaped configuration. The contact portion 22 has both side portions thereof bent at a predetermined angle, and thus, has a horizontal plane 22*a* and inclined planes 22*b* on both of the sides of the horizontal plane 22*a*.

The fixed portion 23 is provided with half-circular concavities 26 on both of the sides thereof. The concavities 26 are fitted onto the ribs 18 of the upper insulating case 2B, respectively, so that the fixed terminal 21 is incorporated in the upper insulating case 2B at a high positional accuracy. At this time, the fixed terminal 21 is incorporated with the horizontal surface 22*a* and the fixed portion 23 of the contact portion 22 being in close contact with the bottom of the upper insulating case 2B. A gap is generated in the area where the fixed terminal 21 intersects the groove 15.

Figure 3:
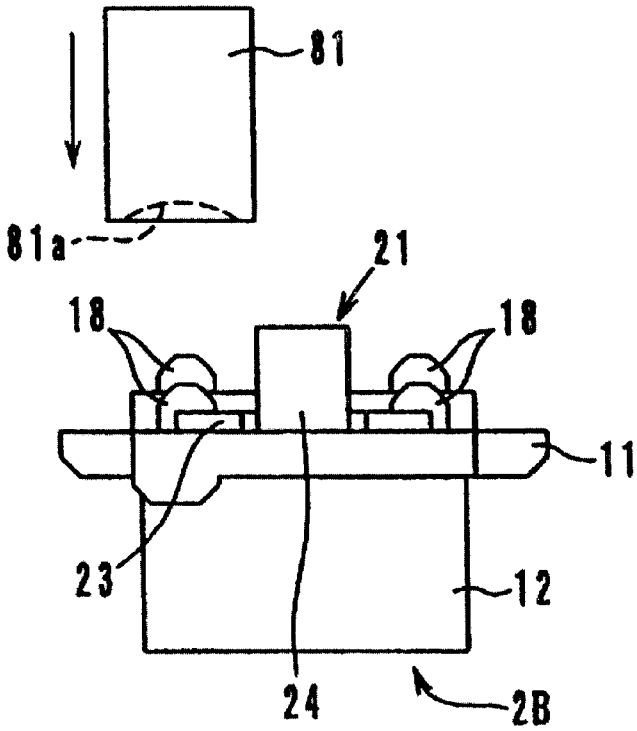
FIG. 3 is a side view illustrating an assembling process of the coaxial connector shown in FIG. 2.
Figure 4:
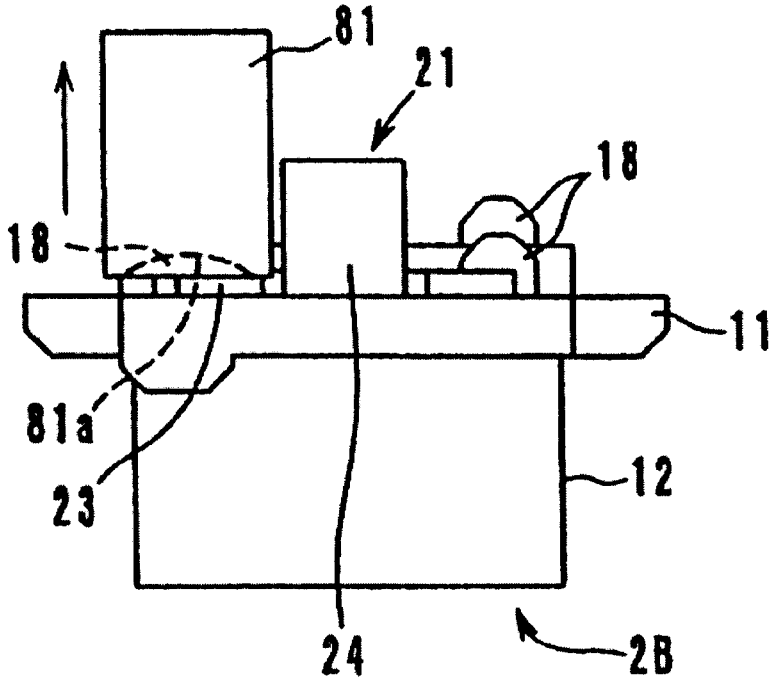
FIG. 4 is a side view illustrating an assembling process of the coaxial connector shown in FIG. 3.
Figure 5:
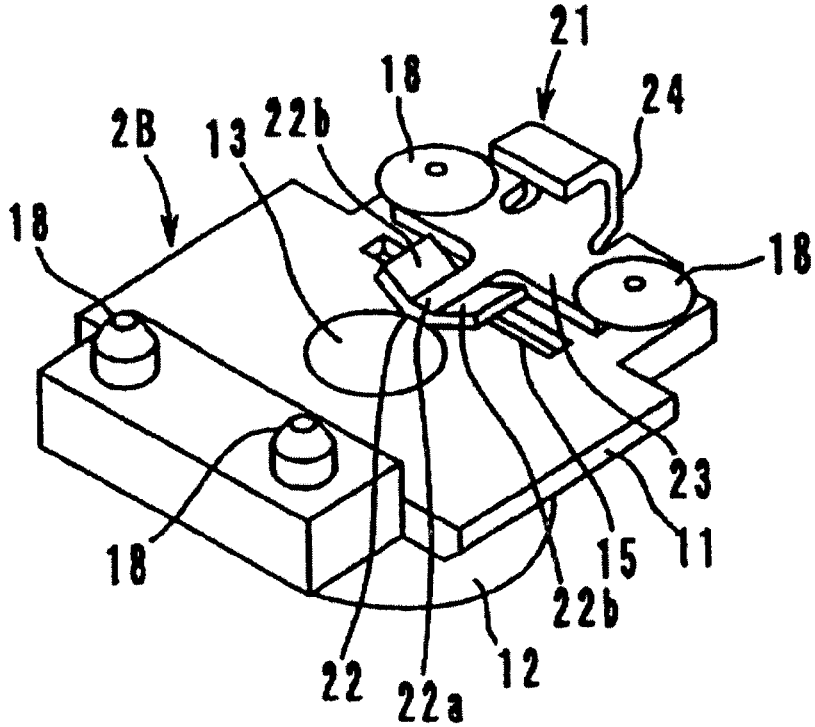
FIG. 5 is a perspective view illustrating an assembling process of the coaxial connector shown in FIG. 4.

Then, as shown in FIG. 3, the head chip 81 of a welder is lowered from the upper side of each rib 18 positioning the fixed terminal 21 to be pushed against the rib 18. FIG. 3 is a side view of the coaxial connector taken in the direction indicated by arrow K in FIG. 2. The top surface 81*a* of the head chip 81 preferably has a concave plane shape, i.e., has a reversed dome shape. At this time, the head chip 81 is sufficiently heated at a temperature at which the rib 18 can be thermally deformed. Accordingly, as shown in FIG. 4, the rib 18 is thermally deformed by the tip 81*a* of the heat chip 81 so as to have a domed shape. Thereafter, the head chip 81 is elevated. Similarly, the other rib 18 positioning the fixed terminal 21 is thermally deformed so as to have a domed shape. Thus, as shown in FIG. 5, the fixed terminal 21 is welding-fixed to the bottom of the upper insulating case 2B via the thermally deformed dome-shaped ribs 18.

The movable terminal 31 (see FIG. 1) is preferably formed by punching a metallic sheet having a spring property into a predetermined shape and bending it. The movable terminal 31 is constructed to have a spring-movable function, and includes a movable contact portion 32 that contacts with the fixed terminal 21, a fixed portion 33 fixedly sandwiched between the insulating cases 2A and 2B, and a lead 34 bent into a substantially L-shaped configuration. The movable contact portion 32 is bent so as to rise upward in an arc shape. Spring supports 37 are provided on both of the ends of the movable contact portion 32, and a spring contact portion 38 is provided in the center thereof.

Figure 6:
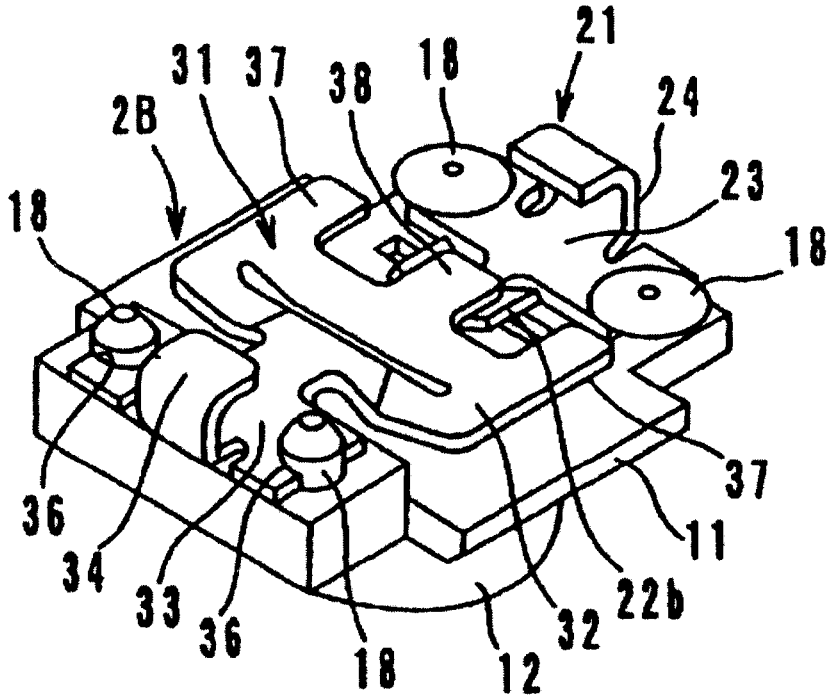
FIG. 6 is a perspective view illustrating an assembling process of the coaxial connector shown in FIG. 5.

Half-circular concavities 36 are provided on both of the sides of the fixed portion 33. As shown in FIG. 6, the concavities 36 are fixed onto the ribs 18 of the upper insulating case 2B, respectively, so that the movable terminal 31 is incorporated into the upper insulating case 2B with a high positional accuracy. At this time, the movable terminal 31 is incorporated with the fixed portion 33 so as to be in close contact with the bottom of the insulating case 2B.

Figure 7:
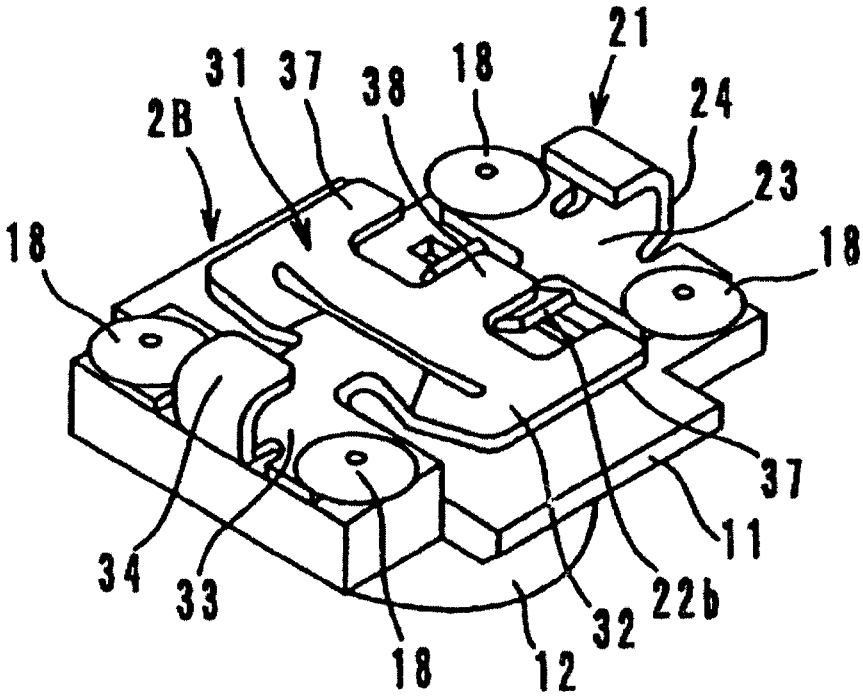
FIG. 7 is a perspective view illustrating an assembling process of the coaxial connector shown in FIG. 6.

Next, head chips 81 of a welder are pushed against the two ribs 18 positioning the movable terminal 31 using the same procedures as described in reference to FIGS. 3 and 4, so that the ribs 18 are thermally deformed into a dome shape. Thus, as shown in FIG. 7, the movable terminal 31 is welding-fixed to the bottom of the upper insulating case 2B via the ribs 18 that are thermally deformed into a domed shape.

In order for the external terminal 41 (see FIG. 1) to come into contact with the outer conductor of a mating coaxial connector, the external terminal 41 is preferably formed by punching a metallic sheet, e.g., made of brass, spring-use phosphor bronze, or other suitable material, via bending, drawing, or other suitable process. A flat portion 42 in the center of the sheet body is arranged to cover the upper surface of the upper insulating case 2B. Legs 43 are disposed preferably at the four corners of the flat portion 42, respectively. Moreover, in the center of the flat portion 42, a substantially cylindrical through-hole portion 45 is arranged so as to be concentric with the columnar introduction portion 12 of the upper insulating case 2B. The substantially cylindrical through-hole portion 45 is fitted into the outer conductor of the mating coaxial connector. Ordinarily, the external terminal 41 functions as a ground. The outer surface of the external terminal 41 is plated, if necessary.

Figure 8:
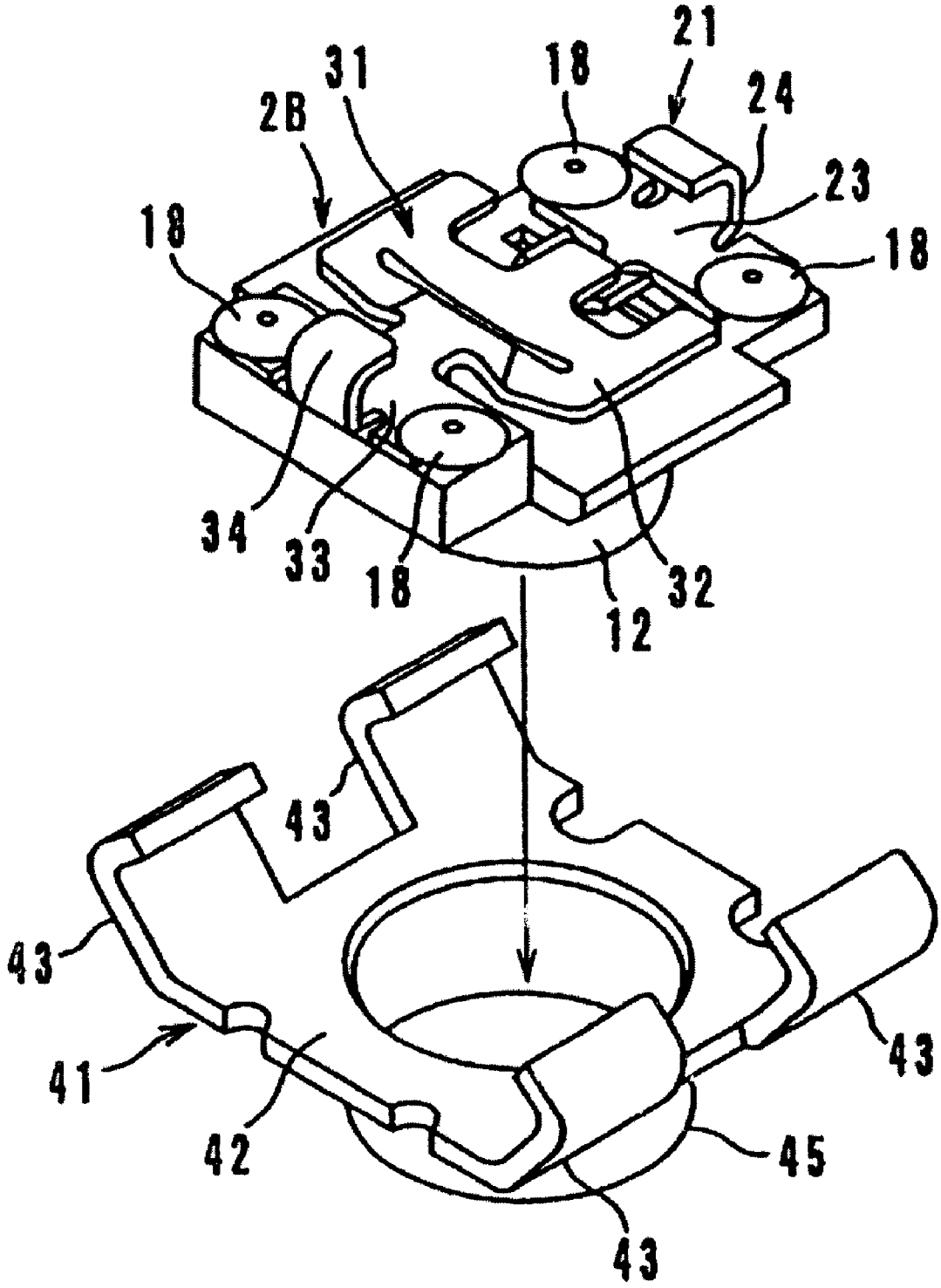
FIG. 8 is a perspective view illustrating an assembling process of the coaxial connector shown in FIG. 7.
Figure 9:
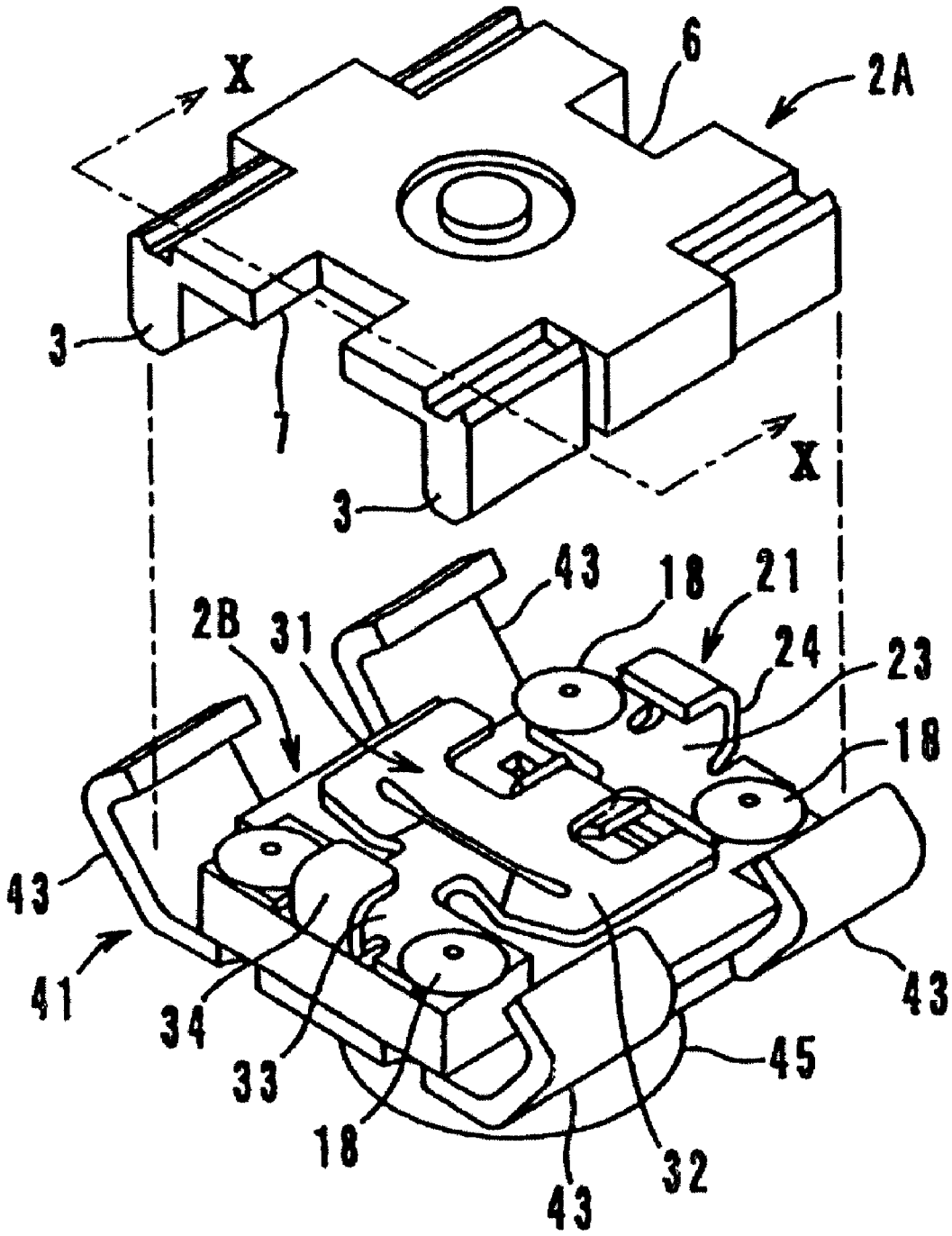
FIG. 9 is a perspective view illustrating an assembling process of the coaxial connector shown in FIG. 8.

As shown in FIG. 8, the upper insulating case 2B having the terminals 21 and 31 fixed thereto is incorporated into the external terminal 41. That is, the columnar introduction portion 12 of the upper insulating case 2B is fitted into the substantially cylindrical through-hole portion 45 of the outer terminal 41. Thereafter, as shown in FIG. 9, the lower insulating case 2A is overlaid on and incorporated into the upper insulating case 2B.

Figure 10:
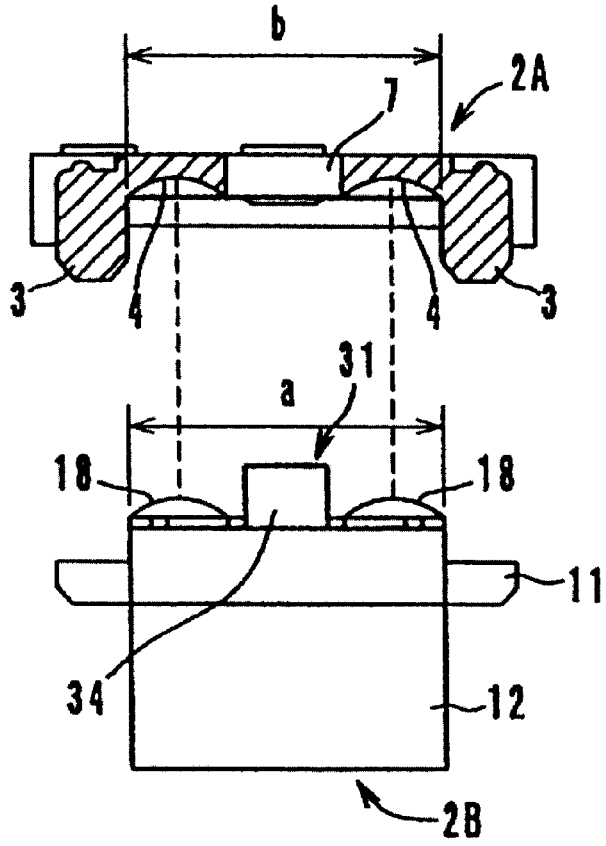
FIG. 10 is a partial cross sectional view illustrating self-alignment effects between the insulating cases.

Ordinarily, as shown in FIG. 10, the size a of the upper insulating case 2B is preferably smaller than the size b of the lower insulating case 2A. This is carried out to improve the working efficiency with which the lower insulating case 2A is incorporated into the upper insulating case 2B. FIG. 10 is a partial cross sectional view of the coaxial connector taken along the direction of X—X in FIG. 9.

Figure 11:
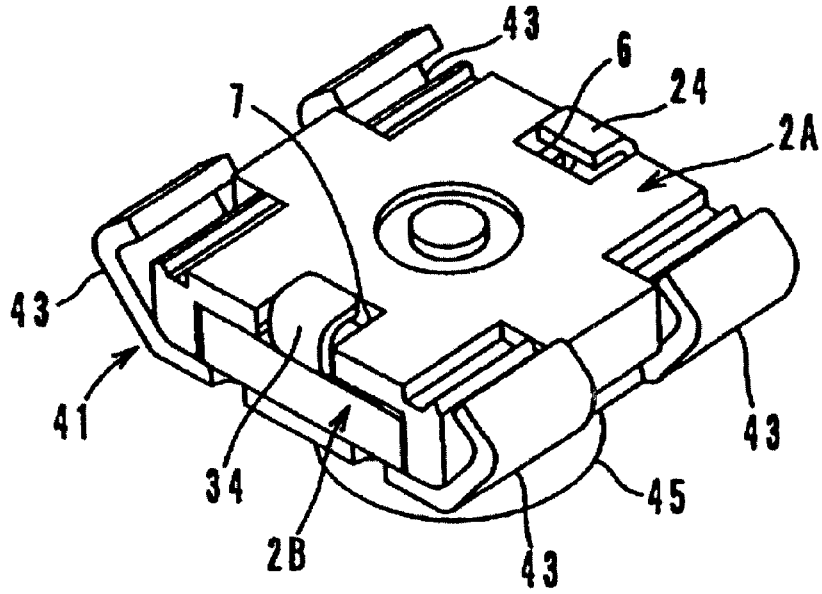
FIG. 11 is a perspective view illustrating an assembling process of the coaxial connector shown in FIG. 9.

However, if the sizes a and b have the relationship of a<b, the incorporated lower insulating case 2A is shaky, that is, the phenomenon occurs, in which the position of the lower insulating case 2A becomes unstable. Accordingly, in the first preferred embodiment of the present invention, the ribs 18 of the upper insulating case 2B are thermally deformed to have a dome shape, and also, the rib receiving portions 4 of the lower insulating case 2A have a reversed dome shape. That is, when the ribs 18 are combined with the rib relief portions 4, a self-alignment effect is produced, so that the lower insulating case 2A can be incorporated into the upper insulating case 2B with a high accuracy, and moreover, errors in the location can be prevented (see FIG. 11).

Figure 12:
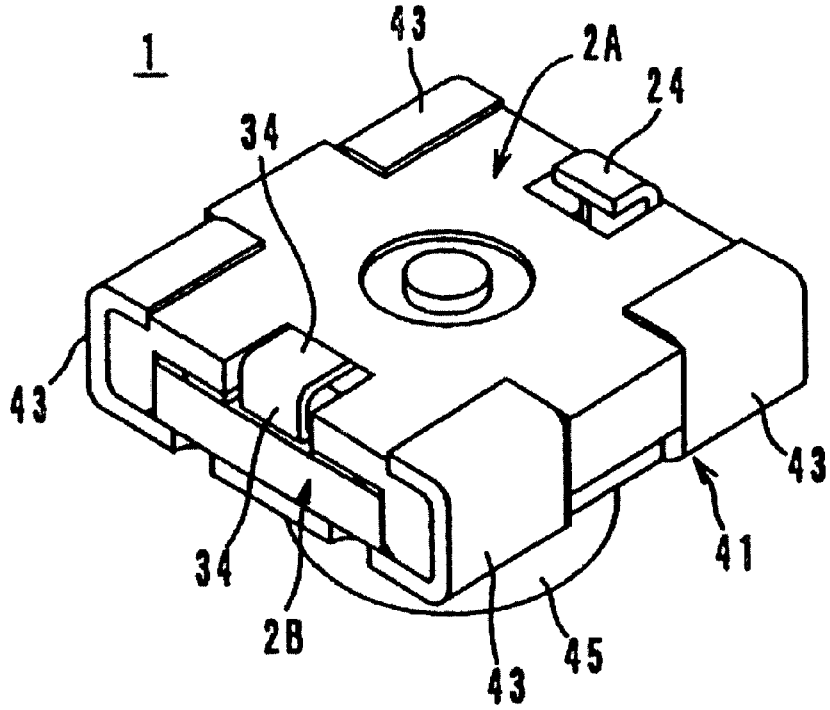
FIG. 12 is a perspective view illustrating an assembling process of the coaxial connector shown in FIG. 11.

Next, as shown in FIG. 12, the legs 43 of the outer terminal 41 are bent along the side surface and the bottom of the assembly including the terminals 21 and 31, and the insulating cases 2A and 2B. Accordingly, the assembly has a stiff, rigid, and stable structure.

Figure 13:
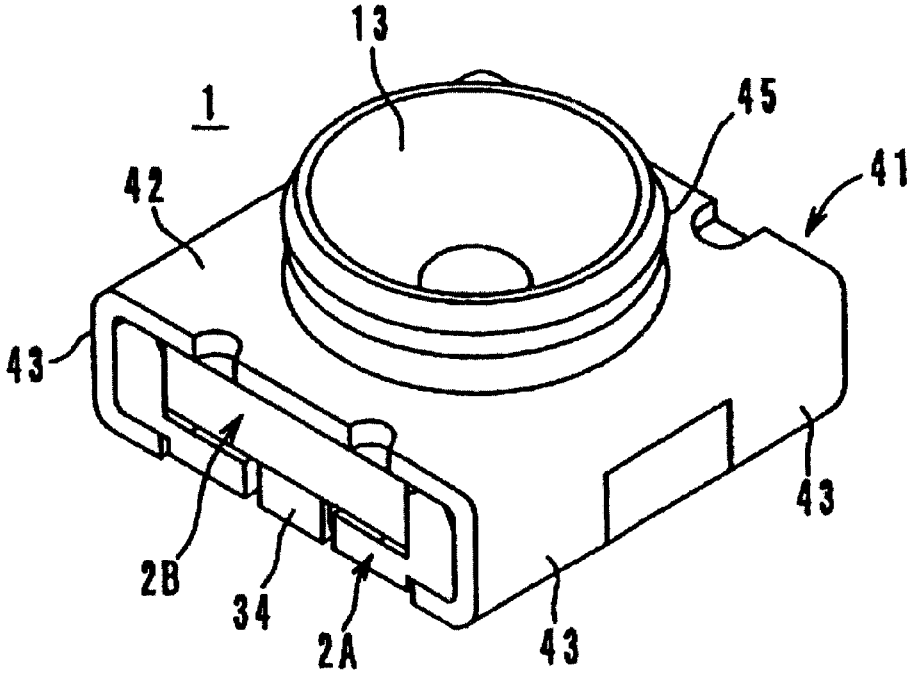
FIG. 13 is a perspective view showing the appearance of the coaxial connector of FIG. 1.

FIG. 13 is a perspective view of the coaxial connector 1 having a switching function, assembled as described above and viewed from the upper surface of the connector 1. In the coaxial connector 1, the top portions of the leads 24 and 34 of the terminals 21, 31, and 41, and those of the legs 43 are formed substantially on the same plane as the bottom of the lower insulating case 2A. Thus, the coaxial connector 1 has such a structure that surface-mounting can be carried out. Moreover, in the external terminal 41, the substantially cylindrical through-hole portion 45 is arranged so that stable and secure connection to the mating coaxial connector can be achieved.

Figure 14:
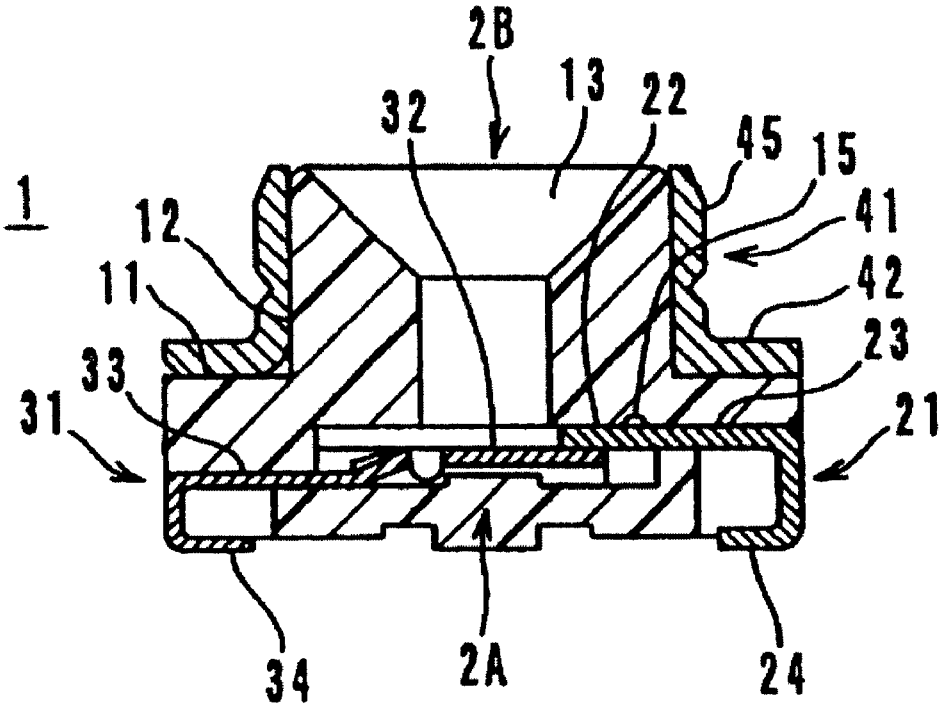
FIG. 14 is a cross sectional view of the coaxial connector shown in FIG. 12.

As shown in FIG. 14, in the inner space of the insulating case, defined by the combination of the insulating cases 2A and 2B, the fixed terminal 21 and the movable terminal 31 are arranged so that the fixed terminal 21 lies on the movable terminal 31. In the coaxial connector 1, the sizes of the contact portion 22 of the fixed terminal 21 and the movable contact portion 32 of the movable terminal 31 are relatively small. Thus, it is a large factor in enhancement of the mechanical performance (the spring performance of the movable contact portion 32) of the coaxial connector 1 that the contact positions of the contact portion 22 and the movable contact portion 32 are accurately determined. On the other hand, the positions of the terminals 21 and 31 can be accurately determined via the ribs 18 provided for the upper insulating case 2B, and therefore, the contact position between the movable contact portion 32 of the movable terminal 31 and the contact portion 22 of the fixed terminal 21 can be accurately determined. Accordingly, the coaxial connector 1 having high qualities can be obtained.

Furthermore, the dome-shaped ribs 18 fix the terminals 21 and 31 to the upper insulating case 2B. Accordingly, there is no danger that the terminals 21 and 31 are released or shifted from the upper insulating case 2B, which was caused by vibration and impact that occurs when the device elements are conveyed, during assembling. Furthermore, since the ribs 18, which are arranged to position the terminals 21 and 31, are thermally deformed by the welder so that the heights are reduced. Therefore, the overall thickness of the overlapped terminals 21 and 31 can be reduced, and thus, the total thickness of the assembly, obtained when the insulating cases 2A and 2B are overlaid is minimized. Thus, the coaxial connector 1 having a reduced thickness can be provided.

Hereinafter, operation of the coaxial connector 1 will be described with reference to FIGS. 14 and 15.

As shown in FIG. 14, when the mating coaxial connector is not mounted, the movable contact portion 32 is in the state that the center portion thereof is bent upward, and thereby, the movable terminal 31 is in contact with the fixed terminal 21, due to the elastic force generated by the spring property of the movable contact portion 32. Thus, both of the terminals 21 and 31 are electrically connected to each other.

Figure 15:
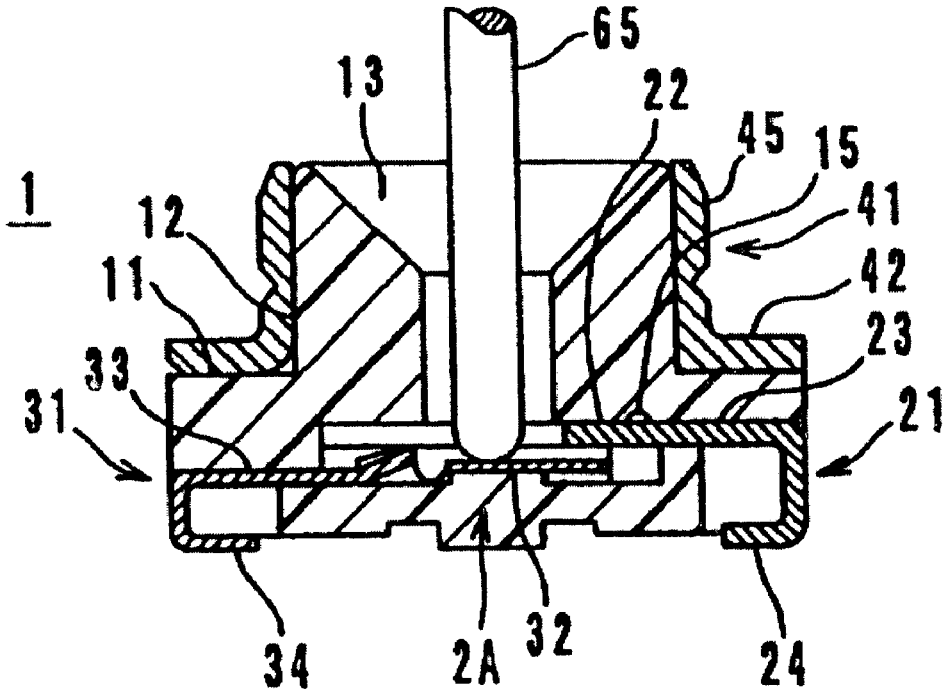
FIG. 15 is a cross sectional view showing a mating coaxial connector fitted into the coaxial connector of FIG. 12.

On the other hand, as shown in FIG. 15, when the mating coaxial connector is mounted, the center contact 65 of the mating coaxial connector is inserted through the introduction hole 13 disposed on the upper side of the coaxial connector 1 to push the center portion of the movable contact portion 32 downward. Thus, the center portion is inverted and moves into the state that the center portion is bent downward into an arc shape. Thereby, the spring contact portion 38 of the movable terminal 31 is released from the contact portion 22 of the fixed terminal 21, so that the electrical connection between the fixed terminal 21 and the movable terminal 31 is interrupted, while the center contact 65 and the movable terminal 31 are electrically connected to each other. Simultaneously, the outer conductor (not shown) of the mating coaxial connector is fitted onto the outer terminal 41, so that the outer conductor and the external terminal 41 are electrically connected to each other.

When the mating coaxial connector is released from the coaxial connector 1, the center portion of the movable contact portion 32 is restored to the state that the center portion is bent upward, utilizing the spring property. Thereby, the fixed terminal 21 and the movable terminal 31 are electrically connected to each other again, while the electrical connection between the center contact 65 and the movable terminal 31 is interrupted.

A portable telephone as an example of a communication device according to a second preferred embodiment of the present invention will be described.

Figure 16:
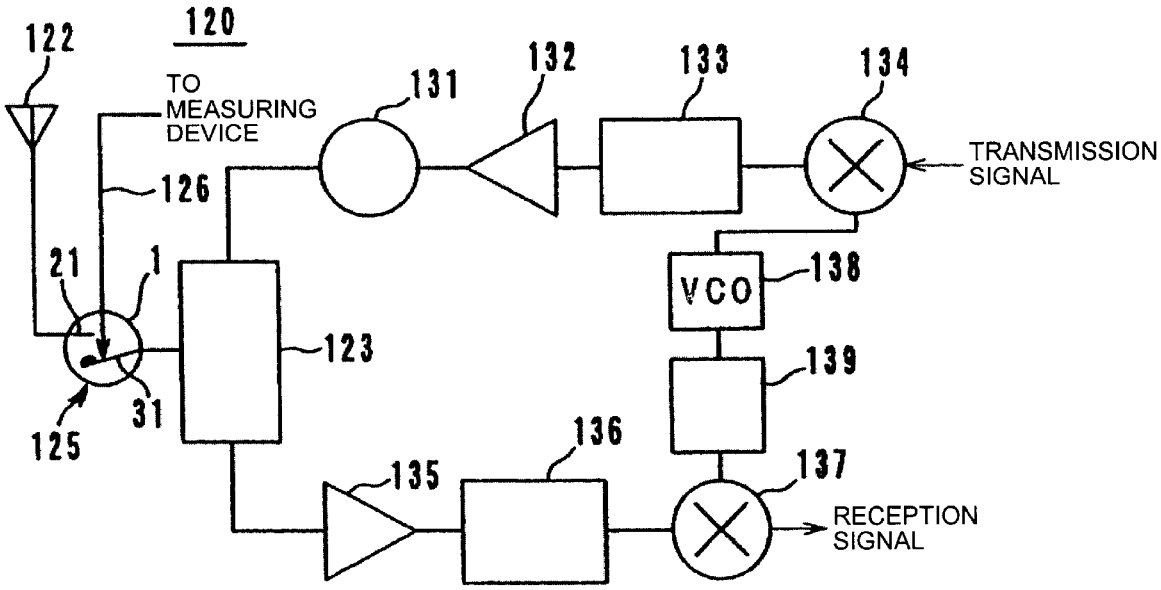
FIG. 16 is a block diagram showing a preferred embodiment of a communication device of the present invention.

FIG. 16 is an electric circuit block diagram of the RF circuit portion of a portable telephone 120. In FIG. 16, an antenna 122, a diplexer 123, a change-over switch 125, a transmission side isolator 131, a transmission side amplifier 132, a transmission side inter-stage band-pass filter 133, a transmission side mixer 134, a reception side amplifier 135, a reception side inter-stage band-pass filter 136, a reception side mixer 137, a voltage control oscillator (VCO) 138, and a local band-pass filter 139 are shown.

Here, as the change-over switch 125, the coaxial connector 1 of the first preferred embodiment can be used. Thereby, for example, when an apparatus manufacturer checks the electrical characteristics of the RF circuit portion during the manufacturing process of a portable telephone 120, a measuring probe (mating coaxial connector) 126 connected to a meter, is fitted onto the coaxial connector 1, and thereby, the signal path from the RF circuit portion to the antenna 122 can be changed to the signal path from the RF circuit portion to the meter. When the measuring probe 126 is released from the coaxial connector 1, the signal path is returned to the signal path from the RF circuit portion to the antenna 122. Thus, the portable telephone 120 having a high reliability can be realized by including the coaxial connector 1 in the portable telephone 120.

The present invention including the coaxial connector and the communication device including the coaxial connector is not limited to the above-described preferred embodiments. The present invention can be modified within the scope and the sprit of the present invention. The ribs to be provided for the insulating case may be formed on the upper insulating case 2B as described in the above-described preferred embodiments, or may be provided on the lower insulating case 2A. Moreover, as the outer profile of the insulating case and the shape of the concave portions, optional shapes and sizes such as substantially rectangular and substantially circular shapes may be selected, as desired.

As seen in the above description, according to preferred embodiments of the present invention, since the ribs for positioning the fixed terminal and the movable terminal are disposed on one of the first resin member and the second resin member, the fixed terminal and the movable terminal can be accurately positioned by the ribs. Thus, a coaxial connector and a communication device having high qualities can be obtained.

Moreover, the ribs, which are thermally deformed, fix the fixed terminal and the movable terminal, which define signal terminals, to one of the first resin member and the second resin member. Thus, there is no danger that the signal terminals are released or shifted from the resin members, caused by vibration and impact while the device elements are conveyed during assembling. For this reason, it is unnecessary to provide additional counter-measures against vibration and impact in the production facilities. Thus, the cost of the production facilities can be reduced. Moreover, rejected products can be prevented, caused by release of the signal terminals during production. Thus, great improvement of the production efficiency and reduction in cost of the products are achieved.

Moreover, when the first resin member and the second resin member are joined together, the ribs which are thermally deformed into a dome shape, cooperate with the rib receiving portions having a reversed dome shape, so that relative shift between the first resin member and the second resin member is prevented.

While the present invention has been particularly shown and described with reference to preferred embodiments thereof, it will be understood by those skilled in the art that the foregoing and other changes in form and details can be made without departing from the spirit and scope of the present invention.

What is claimed is:

1. A coaxial connector comprising:

a first resin member having a concave portion into which a center contact of a mating coaxial connector is inserted;

a second resin member arranged to mate with and define an insulating case with the first resin member;

a fixed terminal and a movable terminal mounted inside of the insulating case; and an external terminal mounted on the outside of the insulating case to be electrically connected to an outer conductor of the mating coaxial connector; wherein the first resin member is provided with ribs at corner portions thereof, the ribs being arranged to position the fixed terminal and the movable terminal, respectively, and the fixed terminal is provided with a fixed portion fixedly sandwiched between the first and second resin members, said fixed portion includes at least one concavity which is fitted onto at least one of the ribs disposed on the first resin member.

2. A coaxial connector according to claim 1, wherein the ribs are thermally deformed so that the fixed terminal and the movable terminal are fixed to the first resin member.

3. A coaxial connector according to claim 1, wherein the ribs are thermally deformed and have a dome shape, and are provided on the first resin member, and rib receiving portions having a reversed dome shape are provided on the second resin member.

4. A coaxial connector according to claim 1, wherein the fixed terminal, the movable terminal and the outer terminal are made of metal.

5. A coaxial connector according to claim 1, wherein the first resin member is smaller than the second resin member.

6. A coaxial connector according to claim 1, wherein the first resin member includes guiding protuberances for positioning the first resin member on the second resin member.

7. A coaxial connector according to claim 1, wherein the fixed terminal includes a contact portion that is in contact with the movable terminal, a fixed portion fixedly sandwiched between the first and second resin members, and a lead that has a substantially L-shaped configuration.

8. A coaxial connector according to claim 1, wherein the movable terminal includes a movable contact portion that contacts with the fixed terminal, a fixed portion fixedly sandwiched between the first and second resin members, and a lead having a substantially L-shaped configuration.

9. A coaxial connector according to claim 8, wherein the fixed portion includes concavities which are fitted onto the ribs disposed on the first resin member.

10. A communication device comprising:

at least one coaxial connector including:

a first resin member having a concave portion into which a center contact of a mating coaxial connector is inserted;

a second resin member arranged to mate with and define an insulating case with the first resin member;

a fixed terminal and a movable terminal mounted inside of the insulating case; and an external terminal mounted on the outside of the insulating case to be electrically connected to an outer conductor of the mating coaxial connector; wherein the first resin member is provided with ribs at corner portions thereof, the ribs being arranged to position the fixed terminal and the movable terminal, respectively, and the fixed terminal is provided with a fixed portion fixedly sandwiched between the first and second resin members, said fixed portion includes at least one concavity which is fitted onto at least one of the ribs disposed on the first resin member.

11. A communication device according to claim 10, wherein the ribs are thermally deformed so that the fixed terminal and the movable terminal are fixed to the first resin member.

12. A communication device according to claim 10, wherein the ribs are thermally deformed and have a dome shape, and are provided on the first resin member, and rib receiving portions having a reversed dome shape are provided on the second resin member.

13. A communication device according to claim 10, wherein the fixed terminal, the movable terminal and the outer terminal are made of metal.

14. A communication device according to claim 10, wherein the first resin member is smaller than the second resin member.

15. A communication device according to claim 10, wherein the first resin member includes guiding protuberances for positioning the first resin member on the second resin member.

16. A communication device according to claim 10, wherein the fixed terminal includes a contact portion that is in contact with the movable terminal, a fixed portion fixedly sandwiched between the first and second resin members, and a lead that has a substantially L-shaped configuration.

17. A communication device according to claim 10, wherein the movable terminal includes a movable contact portion that contacts with the fixed terminal, a fixed portion fixedly sandwiched between the first and second resin members, and a lead having a substantially L-shaped configuration.

18. A communication device according to claim 17, wherein the fixed portion includes concavities which are fitted onto the ribs disposed on the first resin member.

* * * * *